United States Patent [19]

Briley

[11] 4,297,200

[45] Oct. 27, 1981

[54] METHOD FOR HYDROCONVERSION OF SOLID CARBONACEOUS MATERIALS

[76] Inventor: Patrick B. Briley, 131 Lee La., Bolingbrook, Ill. 60439

[21] Appl. No.: 113,222

[22] Filed: Jan. 18, 1980

[51] Int. Cl.[3] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 4,008,054 | 2/1977 | Clancey et al. | 208/8 LE X |
| 4,045,328 | 8/1977 | Green et al. | 208/8 LE |
| 4,048,054 | 9/1977 | Green et al. | 208/8 LE |
| 4,110,192 | 8/1978 | Hildebrand et al. | 208/10 X |
| 4,121,995 | 10/1978 | Hsu | 208/10 X |
| 4,158,948 | 6/1979 | Schlinger | 208/8 LE X |
| 4,189,371 | 2/1980 | Maa et al. | 208/10 X |

*Primary Examiner*—Delbert E. Gantz
*Assistant Examiner*—William G. Wright
*Attorney, Agent, or Firm*—Christopher H. Morgan

[57] ABSTRACT

A method for hydroconversion of solid carbonaceous material including a solids containment set of streams wherein a hydrocarbon solvent contacts the solid carbonaceous material for dissolution and hydroconversion combined with a method of hydrogenation.

42 Claims, 1 Drawing Figure

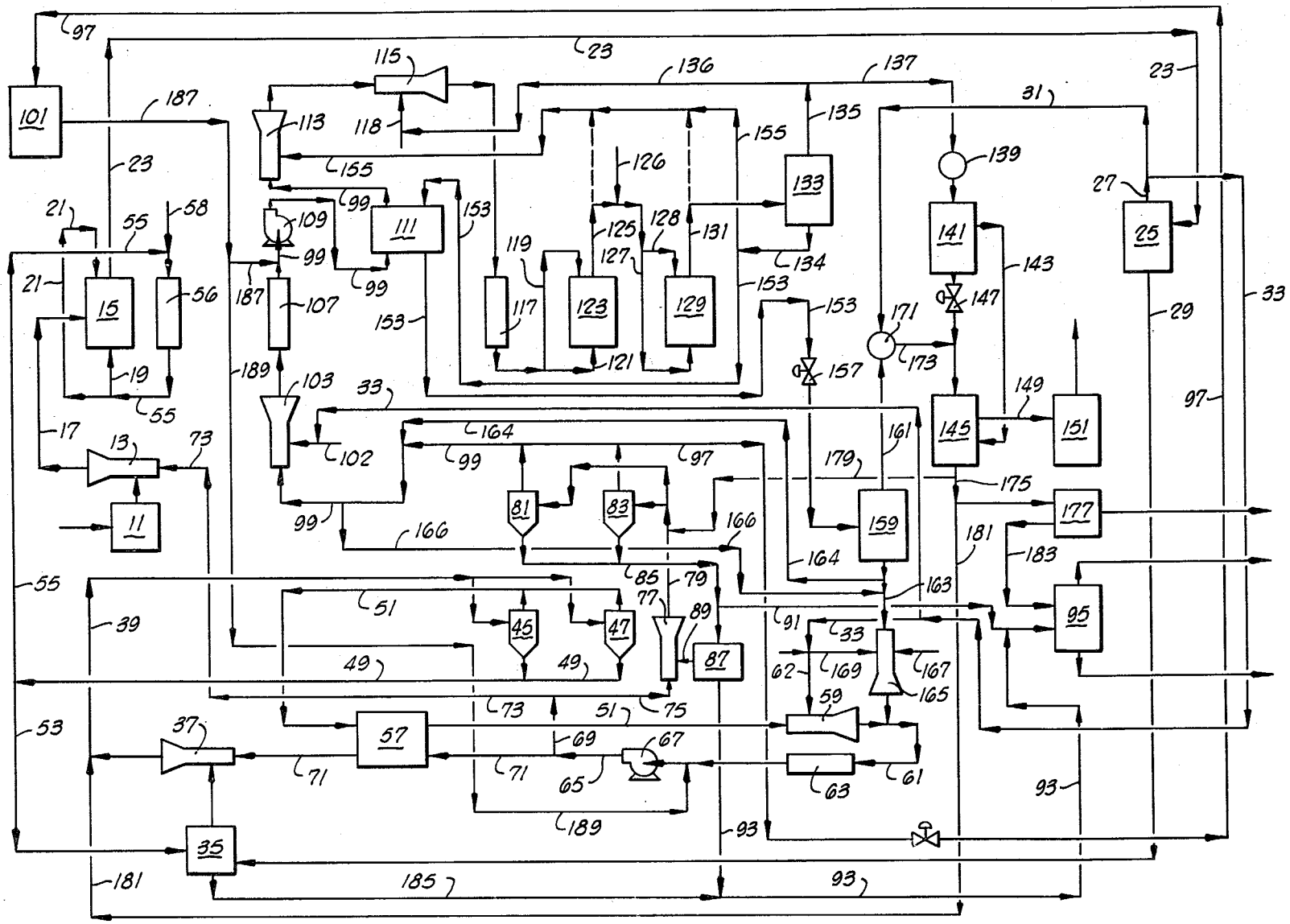

METHOD FOR HYDROCONVERSION OF SOLID CARBONACEOUS MATERIALS

BACKGROUND OF THE INVENTION

1. Field of the Invention

This invention relates in general to hydroconversion and more particularly to a method of hydroconversion of solid carbonaceous materials.

2. Description of the Prior Art

Due to the shortage of liquified hydrocarbon fuels and related chemicals, research in the area of hydroconversion of solid carbonaceous material has increased in an effort to produce these fuels and chemicals. However, most of the fundamental chemistry involved in hydroconversion of carbonaceous material has been known for some time. Nevertheless, new processes for coal liquefaction and coal gasification are constantly being invented to provide advantageous new methods of utilizing the known chemistry. A representative sampling of some of the inventions are shown in U.S. Pat. Nos. 3,856,675; 3,852,183; 3,852,182; 3,790,467; 3,607,719; 3,594,303; 3,540,995; 3,514,394; and Re. 25,770.

A particular problem of the prior art has been that the equipment required for hydroconversion of coal or the like has been very expensive. One reason for this expense has been the necessity of using only very high temperatures and pressures. In fact, many inventions have been devoted to coping with these high temperatures and pressures.

Another problem of the prior art is also due, in part, to the high pressures and temperatures used in these processes. This problem involves the addition of hydrogen to a hydroconversion process. In the past, hydrogen has been usually added to systems for hydrogenation under very high pressure. Furthermore, more hydrogen than necessary for hydrogenation has been added because the excess hydrogen increases the rate of hydrogenation. This excess hydrogen requires a larger gas compressor than necessary and leads to larger and more complex hydrogen purification and recycle system components. Since gas compressors and hydrogen purification and recycle system components are expensive and inefficient, the use of this excess hydrogen results in high costs.

Still another problem in the prior art has been the removal of finely dispersed minerals and metals (ash) during the hydroconversion process. In the past, these solids have been removed in processes which either are unreliable due to plugging or are inefficient due to loss of feed and product materials during separation from the hydrocarbons. The ash has usually been removed at the beginning of the hydroconversion processes to prevent plugging of catalyst beds, to reduce erosion in components, and to ensure products have low ash content.

SUMMARY OF THE INVENTION

It is accordingly an object of the present invention to provide a new and improved process for hydroconversion of solid carbonaceous material. It is also an object of the present invention to provide such a process which can operate at a variety of temperatures and pressures.

It is also an object of the invention to provide a process for hydroconversion of solid carbonaceous material which can utilize equipment which costs less due to reduced size (such as reduced reactor volume and compressor sizes) and decreased complexity (such as in solids handling and hydrogen recycle systems). This cost reduction permits construction of portable units which are still economical to operate.

It is yet another object of this invention to provide such a process which allows the addition of hydrogen at relatively lower pressures and reduces the amount of excess hydrogen that must be purified and recycled.

Still another object of the present invention is to provide a hydroconversion process which has a more reliable and efficient method of handling the mineral matter and metals (ash) in solid carbonaceous materials.

In accordance with these objects, the process of hydroconversion of solid carbonaceous materials of this invention contacts in a dissolution zone solid carbonaceous material with a hydrocarbon solvent. A first stream containing hydrocarbon liquids, hydrocarbon gases and particulate carbonaceous material is removed from the dissolution zone and then separated into a second and a third stream, the second stream consisting substantially of gas phase material. A solids separation device separates the third stream into a fourth stream and a fifth stream, the fourth stream having an average solid size smaller than the average solid size of said fifth stream. At least a portion of the fifth stream is introduced into the dissolution zone. The fourth stream is separated into a sixth and seventh stream and at least a portion of the seventh stream is introduced into the third stream. Molecular hydrogen is added to the sixth stream and the sixth stream is heated and introduced into a catalytic hydrogenation zone. An eighth stream is removed from the catalytic hydrogenation zone and separated into a ninth stream and a tenth stream; the ninth stream consisting substantially of gas phase materials. The tenth stream is added to the fourth stream. These steps are repeated until the desired amount of hydroconversion is achieved.

It is desirable to add at least a portion of the hydrogen to the system by adding hydrogen to a stream at a first pressure, dispersing the hydrogen in the stream and then increasing the pressure of the stream to a pressure higher than the first pressure.

For a further understanding of the invention and further objects, features and advantages thereof, reference may now be had to the following description taken in conjunction with the accompanying drawing.

BRIEF DESCRIPTION OF THE DRAWING

The FIGURE is a schematic view of the process of hydroconversion of solid carbonaceous material of the present invention.

DESCRIPTION OF THE PREFERRED EMBODIMENTS

Referring now to the FIGURE, the process of the present invention is shown schematically. The lines of the FIGURE represent streams of material being transferred from one apparatus or stream to another. The blocks represent particular kinds of apparatus such as, for example, a pump, a heat exchanger, or a reaction vessel.

The process of the present invention is for hydroconversion of solid particulate carbonaceous material and is achieved by contacting this material with molecular hydrogen and a hydrogen donor solvent.

The term "hydroconversion" applies to dissolution of carbonaceous solids as well as hydrogenation of these solids and hydrogenation of any liquids derived from or in contact with these solids. The term "hydrogen donor solvent" as used herein applies to hydrocarbon liquids which are capable of donating chemically bound hydrogen to hydrocarbon liquids and carbonaceous solids and can have this donating capability restored by hydrogenation of the hydrogen donor solvent. Hydrogen donor solvents for coal include, but are not limited to, hydrocarbon liquids boiling above about 350° F. and derived from coal. The term "hydrogenation" as used herein applies to chemically reacting molecular hydrogen or chemically bound hydrogen in donor solvent liquids with hydrocarbon liquids and carbonaceous solids either in the presence of or without the presence of a catalyst. Hydrogenation processes are shown in U.S. Pat. Nos. 3,018,241 and 3,171,921.

Hydroconversion in itself, is old in the art. However, the present invention performs this process in a new and synergistic manner. Suitable carbonaceous solids for this process include, but are not limited to, oil bearing shales and coal. In fact, clearly one of the uses of this invention is hydroconversion of coal to hydrocarbon liquids, such as gasoline and fuel oil. Therefore, for the sake of brevity and clarity the process described will be for conversion of coal, even though clearly it applies to hydroconversion of other carbonaceous materials.

Coal is added to the system by coal transfer tank 11. Coal can be added to tank 11 in a variety of ways, but must be of a proper size to allow ejector 13 to draw the coal from tank 11. Furthermore, the coal in tank 11 must be mixed with a suitable liquid in order to provide a transferrable slurry for the ejector. An example of a suitable liquid is creosote oil. Creosote oil is a solvent for coal which can be hydrogenated and used to donate hydrogen to coal. The suction port of ejector 13 is connected to tank 11 such that when liquid is passed through the pressure intake of ejector 13, coal is drawn into the liquid. The outlet of ejector 13 is connected to a coal dissolution vessel 15 by a stream 17. Thus coal drawn from tank 11 by ejector 13 passes to dissolution vessel 15. The solids fed into dissolution vessel 15 are not limited in size, but as a practical matter, should usually be smaller than about 1.0 inch in diameter.

A heated solvent is introduced to dissolution vessel 15 for contacting the particulate coal. Preferably, this contacting occurs such that the particulate coal mixes thoroughly with the solvent. For this reason, the heated solvent is shown entering the dissolution vessel in two streams, 19 and 21. Streams 19 and 21 enter the dissolution vessel 15 at opposite ends of the vessel which improves mixing inside the vessel. This promotes an improved contact of the coal and solvent and thereby increases the efficiency and reduces the required size of the dissolution vessel. The solvent entering dissolution vessel 15 through streams 19 and 21 will be described subsequently. Generally, this solvent will be a hydrogen donor.

In vessel 15 coal and solvent contact such that dissolution and hydroconversion of the coal occur. The temperatures and pressures for hydroconversion of coal in contact with donor solvents are well known. Furthermore, temperatures and pressures to provide maximum conversion are well known. Such pressures for maximum dissolution can be high, often as high as 1500 psi. However, it is not necessary for this process that such pressure be used. Rather, in this process, a wide range of pressures and temperatures can be used depending on the mode of operation chosen. These modes of operation will be described in more detail subsequently.

It is desirable that the weight ratio of solvent to coal in the digester zone be maintained greater than about 1:2 and preferably between about 1:1 and 2:1.

Leaving dissolution vessel 15 is a stream 23 containing hydrocarbon liquids, hydrocarbon gases and particulate carbonaceous material. Stream 23 is drawn from the top of vessel 15 in order to allow gravity separation within the dissolution vessel 15 of the larger particles of coal. This separation can be enhanced by a series of closely spaced and slanted baffles in the top of vessel 15. In this manner, particles larger than a predetermined size can be prevented from entering stream 23 to permit further dissolution of larger particles. Of course, this separation could be achieved in a variety of other ways.

Stream 23 connects dissolution vessel 15 with a separator 25. Separator 25 divides stream 23 into a substantially gas phase stream 27 and a substantially condensed phase stream 29. The lighter gas phase materials are separated from the liquids and solids since these materials have lowered molecular hydrogen concentration and compete for space in the process. The gas phase materials of stream 27 can either be drawn off as product or as fuel gas through stream 31, or reintroduced ultimately to other parts of the system by way of stream 33. Regulation of the flow in stream 31 and stream 33 can be accomplished by valves (not shown).

The separation provided in separator 25 can be achieved by a variety of devices. These range from a simple knockout drum to cyclone separators which will be described subsequently.

Stream 29 connects separator 25 to a solids containment tank 35. Tank 35 serves to hold solids for recycle in the next phase of separation of stream 29. Tank 35 is connected to the suction port of an ejector 37. Thus, the motive liquid passing through ejector 37 draws a part of the contents of the tank 35 into a stream 39 which exits ejector 27. If desired, baffles or other separation devices can be used to retain the largest particles in tank 35 for further dissolution.

As the contents of tank 35 are drawn through ejector 37, hydroconversion of the coal by the hydrogen donor solvent is enhanced. As the coal and solvent enter the ejector 37, a violent mixing of the particulate matter is achieved. This mixing breaks down the particulate matter and causes the solvent to more effectively contact the particles of coal for hydroconversion. Hydrogen gas reaction with the liquids and solids is enhanced and hydrogen donor liquids react more effectively with the carbonaceous solids. Reaction of the coal particles also causes the size of the particles to be reduced and the surface area of the coal solids available for reaction is increased.

Cyclone separators 45 and 47 receive stream 39 in parallel to effect a separation of stream 39 into a stream 49 and a stream 51. Stream 49 exits from the bottom of cyclones 45 and 47 and contains more and larger solids than does stream 51, which exits from the top of cyclones 45 and 47. While two cyclones are shown in the FIGURE, the number of cyclones required is dependent on the volume flow of line 38 and the solids content of line 39. Cyclones 45 and 47 are shown connected in parallel to show how the volume of line 39 can be separated to achieve the proper volume flow through each cyclone.

Cyclones 45 and 47 are well known in the art for achieving a separation of solids and liquids. One such cyclone is sold by Dura Seal. These cyclones achieve a separation by creating a vortex which accelerates the incoming fluid outwardly. Since the solids have a higher density they are moved outwardly with respect to the remainder of the fluid. A central portion of the fluid containing less solids is drawn from the top of the cyclone. The outer portion of the fluid containing a greater amount of solids is drawn from the bottom of cyclone.

Stream 49 containing the higher solid content material from the bottom of cyclones 45 and 47, is split into a stream 53 which connects to solids containment tank 35 and a stream 55. Stream 55 passes into a heater and mixer 56 which heats and mixes the stream. After heating, stream 55 divides into stream 19 and 21. As described above, streams 19 and 21 enter dissolution vessel 15 from opposite ends to promote mixing. If desired, hydrogen gas can be added to stream 55 by a stream 58 prior to heater/mixer 56 to promote reaction and dissolution of the coal in the dissolving tank 15. The heater/-mixer 56 heats the mixer to practical reaction and dissolution temperatures and mixes the hydrogen so as to promote more rapid reaction and dissolution. The preferred mixer is a helical flow mixer which will be described later. Thus, the higher solid content material from the bottom of cyclones 45 and 47, is heated and hydrogen gas added prior to entering dissolution tank 15.

Stream 51, containing the lower solid content material from the top of cyclones 45 and 47, passes through a heat exchanger 57 and then to the inlet of an ejector 59. The outlet of ejector 59 is combined with the outlet stream from ejector 165 to form stream 61. A molecular hydrogen gas input 62 enters the suction inlet of ejector 59. Stream 33, containing light gases including some unreacted hydrogen gas separated at separator 25, is connected to input 62 to allow this gas to also be introduced to stream 61, if desired. Stream 61 passes into a mixer 63 for dispersing the gas throughout the liquid. This allows stream 65 which leaves mixer 63 to pass through a pump 67 without damaging the pump.

In the past, passing liquids with any significant percentage of gas through pumps has been avoided to preclude damage to the pump by cavitation. For this reason, in the hydroconversion of carbonaceous materials, hydrogen gas usually has been added downstream of the pump. This requires that compressors be used to independently raise the pressure of the gas to the pressure downstream of the pump. This can be a more expensive and less efficient method of pressurizing the gas than provided in the present invention.

In the present invention, complete hydroconversion of the carbonaceous materials need not be achieved in a single pass, but rather can be achieved in repeated passes via recycle. This allows a lower volume of hydrogen gas to be added to the system on each pass. In turn, this lower volume of hydrogen gas can be dispersed and dissolved in the liquid by a mixer upstream of a pump, such as pump 67, with a gas bubble size small enough for passage through the pump without damaging the pump. In this manner, the gas in the liquid is pressurized directly by the pump which pressurizes the liquid. This either can eliminate the separate gas compressor or at least reduce the required size of any gas compressors so used.

A suitable type of mixer to achieve dispersion in stream 65 is a helical flow mixer sold by Kenex. This mixer efficiently disperses the gases passing through it. The dispersion serves to dissolve more gas in the liquid as well as entraining the gas in smaller bubbles in the liquid.

As stream 65 leaves pump 67 it is divided into two streams, 69 and 71. Stream 71 passes through heat exchanger 57 and then into the pressure intake of ejector 37. In heat exchanger 57, stream 61 exchanges heat regeneratively with stream 51 and is somewhat reheated prior to entering ejector 37. As can be seen, stream 71 and the pump 59 located therein, provide and regulate the motive force for operating ejector 37. Therefore, the amount of solids recycled through tank 35 and ejector 37 can be controlled by varying the pressure and volume of stream 71. The passage of streams 71 and 51 through heat exchanger 57 achieves three beneficial effects. Heating stream 71 reduces the viscosities of streams 71 and 39 which thereby improves the efficiency of solids separation in cyclones 45 and 47. Cooling stream 51 reduces the temperature capability required for pump 67. Heating stream 71 also increases the rate of hydrogenation and dissolution of carbonaceous solids in stream 71.

From the above description it can be seen that the flow of larger solids is contained in a solids containment portion of the system and recycled through cyclones 45 and 47. This is done to permit greater time for dissolution and conversion of the coal and to minimize plugging of the catalytic reactors. One way of describing this solids containment portion is by paths or zones. In one path, these larger solids, separated from stream 39, are passed to dissolution vessel 15 by way of stream 55 and then back to ejector 37 and stream 39 by stream 23, separator 25, stream 29 and tank 35. In another path, dissolution vessel 15 is avoided. In this second path, the larger solids from stream 39 pass from stream 49 and stream 53 to tank 35 and then to ejector 37 and 39.

This solids containment portion is an important feature of the invention, providing efficient dissolution and hydroconversion of the larger solids in a versatile manner. In this portion of the system the larger carbonaceous solids are recycled and contacted with hydrogen and fresh hydrogen donor solvent until dissolution and hydroconversion reduce their size for maximum conversion before they escape. Furthermore, containing the solids in this manner saves wear on the pumps by reducing the amount of abrasive solids passing therethrough. This is also one of the reasons for using ejectors 13 and 37 instead of pumps. Note that in all cases where ejectors are used, the streams most concentrated in larger particles pass into the ejector via the suction side. This is done to avoid wearing the ejector inlet orifice or nozzle.

Regulation of the flow in the solids containment portion of the system can be varied in several ways, including varying the flow in streams 53 and 55.

Stream 69 after being divided from stream 65, is itself divided into stream 73 and 75. Stream 73 passes into the pressure intake of ejector 13, motivating the suction of coal slurry from tank 11. The amount of coal slurry passed from tank 11 into dissolution vessel 15 can thus be regulated through the volume and pressure of stream 65. Stream 73 is normally used only until the coal from tank 11 has been transferred to dissolution vessel 15.

Stream 75 passes into the motive side of ejector 77 and a stream 79 is formed which exits from ejector 77.

Stream 79 passes into parallel connected cyclones 81 and 83, providing another solids separation. As with cyclones 45 and 47, cyclones 81 and 83 are connected in parallel to stream 79 to allow the volume flow of stream 79 to be divided among the cyclones. The higher solid content liquid from the bottom of cyclones 81 and 83 forms a stream 85 which enters a solids containment tank 87. Solids containment tank 87 is connected by stream 89 to the suction intake of ejector 77. It can be seen that cyclones 81 and 83 are thus connected with tank 87 and ejector 77 to provide an additional solids containment of the same type as provided by cyclones 45 and 47. This additional solids separation provides the same advantages as mentioned in respect to cyclones 45 and 47 and also further reduces the size of the solids which might reach and clog or reduce the life of the catalyst beds.

In this process it is not unusual to encounter substantial quantities of mineral matter, coal and other hydrocarbons having diameters of from 1 to 10 microns. It is important to keep these extremely small particles out of the streams passing through the catalyst zones. These solids can block catalyst pores and plug catalyst beds. Therefore, a solid separation method is required to keep these small particles out of the hydrocarbon liquid passing into the catalytic zones. As shown above, this invention provides such a solid separation in a new and effective manner. The solid separation of the present invention can include either mechanical separators such as cyclones and centrifuges or thermal devices such as vacuum towers, boilers, distillers, etc.; or a combination of these devices. The separation method advanced by this invention includes keeping the extremely small particles in contact with larger particles in dissolution zone 15 and retention tanks 35 and 87. This contact promotes agglomeration of these small particles to form larger particles which are easier to separate in the cyclone or thermal devices. Further addition of liquid product materials boiling below between 250° and 400° F. also promotes this agglomeration and separation. This is because these liquids are sufficiently dissimilar to the coal liquid such that the solids are agglomerated and cast from solution.

The solids fed into dissolution vessel 15 are not limited by size in principle but as a practical matter should be smaller than about 1.0 inch in diameter. The solids leaving the dissolution vessel can be limited in size by baffles, screens, etc., disposed in the dissolution vessel or at the dissolution vessel outlet to promote more dissolution in the vessel 15 before the solids escape. The solids that escape dissolution vessel 15 can be retained for further dissolution in retention tanks 35 and 87 by means of baffles, screens, etc., in the retention tanks. The retention of solids in these tanks can also promote agglomeration of the extremely small particles (less than 10 microns) which contain high amounts of mineral matter (ash) by continuously contacting them with recycled solids from cyclones 45, 47, 81, 83 in streams 53 and 85 and feed solids such as in stream 23. Reducing the amounts of these extremely small particles to the cyclones improves the efficiency of the cyclones in their ability to keep these solids from reaching the catalytic reactors. The baffles or screens in the retention tanks or dissolution vessels should be designed to keep solids greater than about ⅛ inch from leaving the retention tanks to prevent damage to equipment such as ejectors 37 and 77 or pump 67 and cyclones 45, 47, 81 and 83.

The temperature of the streams to cyclones 45, 47, 81 and 83 should be maintained greater than about 300° F. to prevent plugging and to keep the viscosity of the streams high enough to ensure adequate solids separation. This temperature will depend on the solids-to-liquid ratio in the streams but in general will range from about 300° F. to 800° F. for solids-to-liquid ratios from 1:4 to 4:1.

A stream 91 connects part of stream 85 to a holding tank 95. Also, a stream 93 connects tank 87 and tank 35 via stream 185 to holding tank 95. Holding tank 95 can thus receive material from tanks 87 and 35. Normally, streams 91 and 93 are not used until after the solids content of tanks 35 and 87 increase to a predetermined amount.

The stream from the tops of cyclones 81 and 83, containing the relatively solids-free portion separated from stream 79, is divided into two streams 97 and 99. Stream 97 connects to a holding tank 101. The function of tank 101 will be described later. Stream 99 enters the motive side of an ejector 103. The suction intake of ejector 103 is connected to a molecular hydrogen input 102. Stream 33, gas phase material separated in separator 25, is also connected to input 102 since this gas may contain some unreacted hydrogen that should be added to stream 99 at ejector 103. The outlet of ejector 103 is connected to a mixer 107. Mixer 107 serves the same dispersing function as mixer 63 and is accordingly preferably a helical mixer of the type manufactured by Kenex.

The outlet of mixer 107 is connected to a pump 109. As described before, mixer 107 disperses the gases in the liquid entering pump 109 and therefore pump 109 can efficiently pressurize the gas and liquid without damage to the pump. After pump 109 has raised the pressure of the fluid in stream 99 it passes through a heat exchanger 111 and stream 99 is heated. Stream 99 then serves as the motive fluid for a first ejector 113 and then a second ejector 115. The suction intake of ejector 115 is connected to a hydrogen input 118. Stream 136, gas phase material from separator 133, is also connected to input 118 since this gas may contain some unreacted hydrogen which can be recycled. Since the stream passing through ejector 115 is at a relatively high pressure, the molecular hydrogen in input 118 must be pressurized by a compressor. However, the hydrogen added at input 102 at relatively low pressures reduces the amount of hydrogen which needs to be added at relatively higher pressures at input 118 to achieve a desired degree of hydrogenation. As described above this improves the economy of the process by reducing the size of an expensive high pressure gas compressor needed for input 118.

The undissolved hydrogen gas bubble size in the streams leaving mixers (dispersers) 107 and 63 should not be too large so as to damage pumps 109 and 67. For most positive displacement pumps, the preferred bubble size is less than about ⅛ inch in diameter. Also, the volume of undissolved hydrogen should not be more than about 50% of the total stream volume in streams 99 and 65 to prevent damage to these positive displacement pumps.

The outlet of ejector 115 is connected to a heater and mixer 117. Heater and mixer 117 heats and mixes the stream in preparation for catalytic hydrogenation. The mixing in mixers 107 and 117 improves hydrogenation since the bubble size of molecular hydrogen gas in the hydrocarbon liquid is reduced. This size reduction increases gas-to-liquid contact area and increases the amount of molecular hydrogen dissolved in the liquid.

After stream 99 passes through heater and mixer 117, it splits into streams 119 and 121. These two streams enter a catalytic hydrogenation reactor 123 in different directions such that a counter-current flow is produced. This type of flow, as in dissolution vessel 15, improves the efficiency of reaction. The output from catalytic reactor 123 is a stream 125. If desired, molecular hydrogen can be added to stream 124 by hydrogen input 126. Stream 125 is split into two streams, 127 and 128. These two streams enter a second catalytic hydrogenation reactor 129 in two directions to produce a counter-current flow inside the reactor. Any number of catalytic reactors can be used in series with the same pattern of internal recycle as described above.

Suitable catalysts for reactors 123 and 129 include cobalt molybdate, tungsten nickel sulfide, nickel molybdate, tabular alumina, bauxite and mixtures thereof. These catalysts are well known in the art to be suitable for hydrogenation and desulfurization and denitration of hydrocarbons.

Reactors 123 and 129 can be either fixed bed, free floating or ebullated bed reactors. By "free floating beds," it is meant that catalyst is allowed to circulate in the reactor rather than by being constrained in a fixed bed. This catalyst circulation is preferred to increase contact with hydrocarbon liquids and solids thereby increasing hydrogenation and hydroconversion. This catalyst circulation can be promoted by baffles, tank eductors, cross-flow streams 119 and 127, internal draft tubes, etc. The catalyst in these reactors normally are smaller than about ¼ inch in diameter. Catalyst solids can also be circulated between beds 123 and 129. In these reactors, the fluid in the beds should be made to move in as turbulent a motion as possible to improve the catalytic reaction by increasing the effective contact of the catalyst with the reactant liquid and hydrogen. This fluid motion also helps to prevent the catalyst from becoming clogged with particulate material.

Stream 131 exits from catalytic reactor 29 and enters a separator 133. Separator 133 divides stream 131 into streams 134 and 135. Stream 135 is substantially gas phase materials and stream 134 is substantially condensed phase materials. Separator 133, like separator 25, can be of any of several apparatus from a knock-out drum to a cyclone. Gas phase stream 135 is divided into two streams 136 and 137. Stream 136 is connected to the suction inlet of ejector 115. In this way, unreacted molecular hydrogen in the gas phase materials can be recycled and passed through the catalytic reactors 123 and 129 again. This hydrogen recycle reduces the amount of hydrogen which must be compressed and introduced at input 118.

Stream 137 is connected to a condenser 139. The outlet of condenser 139 is connected to a high pressure reduced temperature separator 141. Gas phase materials from separator 141 form a stream 143 which is connected to the bottom end of a stripper 145. The liquid from separator 141 is passed through an expansion valve 147 to the top end of stripper 145. A gas stream 149 from stripper 145 passes into a gas scrubber 151. Gas scrubber 151 removes hydrogen sulfide from the gas in stream 149. Gas from scrubber 151 can be used as fuel gas for the system or as valuable product gas. The separator 141 and expansion valve 147 are operated in combination so as to ensure that the normal boiling point of the lowest boiling point fraction of stream 175 leaving stripper 145 is below 350° F. to 450° F. and that the amount of light aliphatic hydrocarbons in stream 175 is increased. This separation could also be achieved with a fractionation column.

Referring back to separator 133, the liquid phase stream 134 from the bottom of separator 133 is divided into two streams 153 and 155. Stream 155 is connected to the suction inlet of ejector 113. This allows liquid from the outlet of catalytic reactors 123 and 129 to be recycled back through reactors 123 and 129. If desired the fluid from streams 125 and 131, the outlets of catalytic reactors 123 and 129, respectively, can be connected to stream 155 to provide a more immediate recycling. The connections of streams 125 and 131 to stream 135 are shown in dotted lines.

Stream 153 is passed through heat exchanger 111 where it gives up some of its heat to stream 99. Stream 153 then passes through an expansion valve 157 before entering a separator 159. Expansion valve 157 reduces the pressure in stream 153 prior to entering separator 159. The passage of streams 153 and 99 through heat exchanger 111 achieves two beneficial effects. Heating stream 99 reduces the heat load required for heater and mixer 117. Cooling stream 153 reduces the temperature capability required for pump 67.

Separator 159 divides stream 153 into a substantially gas phase stream 161 and a substantially condensed phase stream 163. The separator 159 and expansion valve 157 are operated in combination so as to ensure the normal boiling point of the lowest boiling point fraction in stream 163 is greater than 350° F. to 450° F. Since most hydrogen donors boil above these temperatures, this operation will ensure that hydrogen donor liquids are maintained in stream 163 and are not lost in stream 161. This boiling point separation could also be achieved with a fractionation column. Stream 163 forms the motive fluid stream of an ejector 165. The suction inlet of ejector 165 receives a first hydrogen input 67 and a second hydrogen input 169. These inputs allow molecular hydrogen to be added to stream 163. Since hydrogenation and dissolution of carbonaceous materials are occurring in tanks 35 and 87 in cyclones 45, 47, 81 and 83 and the streams connecting these components, the addition of molecular hydrogen is desirable to increase the rate of hydrogenation and dissolution of these carbonaceous materials. Addition of hydrogen at this point can reduce the amount of hydrogen that is needed in the catalytic reactors since less of the hydrogen in the donor solvents has to be regenerated in the reactors. Stream 33, the gas phase material from separator 25, connects with input 169 to allow those gas phase materials to be recycled into stream 163. Some gas phase materials can be recycled since they may contain some unreacted hydrogen gas.

The outlet stream of ejector 165 joins stream 61 prior to mixer 63. The hydrogen content of hydrogen donor solvents is increased or regenerated in the catalytic reactors. The fresh, regenerated hydrogen donor solvents are in streams 163 and 61 and promote hydroconversion of solid carbonaceous materials and hydrocarbon liquids when mixed with the stream from tank 35 via ejector 37. This mixture also has a lower viscosity due to the presence of these hydrogen donor solvents and thereby improving the separation efficiency of cyclones 45, 47, 81 and 83. Thus, the liquid phase materials from catalytic reactors 123 and 129, after exchanging heat in heat exchanger 111, dropping in pressure across expansion valve 157, and losing gas phase material at separator 159, are recycled to stream 61. Molecular hydrogen can be added to the suction inlet of ejector 165 via stream 167.

A stream 164 connects stream 163 to stream 99 prior to ejector 130. This allows a recycling of the liquid phase materials just described to stream 99 which is derived from the overhead from cyclones 81 and 83. Similarly, a stream 166 connects stream 99 to stream 163 to allow the overhead from cyclones 81 and 83 to be recycled to stream 163 and then stream 61 via ejector 165. The flow in streams 164 and 166 can be regulated to vary the volume rate of flow through reactors 123 and 129, and in cyclones 45, 47, 81 and 83. Stream 166 can keep the hydrogen donor solvent level high in stream 163. Stream 164 returns hydrogen donor solvent to the catalytic reactors for further hydrogenation.

The stream from ejector 165 contains hydrogen donor liquids and molecular hydrogen when added to the streams from ejector 59. Part of these combined streams (stream 71) are mixed in ejector 37 with the higher solids and low molecular hydrogen and low donor solvent containing stream 29 from the dissolution vessel 15 (via stream 23). Hydroconversion of solids and reduction of viscosity of stream 29 occur when stream 29 is mixed with the hydrogen containing stream 71. This reduction in viscosity increases the solid separation efficiency of cyclones 45 and 47. For the same reason the separation efficiency of cyclones 81 and 83 is also increased since stream 69 contains some hydrogen donor solvent from the stream leaving ejector 165.

The gas phase materials stream 161 from separator 159 enters a condenser 171. Stream 31 from stream 27 and separator 25 also enters condenser 171. A stream 173 from condenser 171 enters separator 145, described above. A liquid portion from stripper 145 forms a stream 175, part of which enters a light liquid product tank 177. A suitable liquid fraction making up stream 175 would have a boiling point maintained at a temperature of about 250° F. to 450° F. Streams 179 and 181 connect the remaining part of stream 175 to streams 79 and 39, respectively. This allows the viscosity and boiling points of streams 39 and 79 to be adjusted because streams 179 and 181, via stream 175, contain less viscous, lower boiling point liquids. This change in viscosity is desirable to improve solids separation in cyclones 45, 47, 81 and 83.

If desired, a stream 183 from the bottom of tank 177 can be used to draw off some material for introduction to tank 95. Tank 95 is used to separate solids from product liquids. This separation is promoted by mixing of light aliphatic, hydrocarbon liquids from tank 177 with the heavier aromatic hydrocarbons in tank 95. In this separation process two streams are drawn from tank 95; one stream contains high amounts of solids, while the other contains low amounts of solids. If desired, the solids contained in tank 35 can be conducted to tank 95 by streams 185 and 93 in order to allow the solids from containment tank 35 to be removed from the system. Stream 185 is connected to stream 93 which, in turn, is connected to tank 95.

As can be seen by the above description, the process of this invention provides several recycling points. For example, stream 39, which enters cyclones 45 and 47 from tank 35 is partially recycled to tank 35 by streams 53 and 55. By means of this recycling, a significant flexibility and increased conversions, with less losses, can be achieved. The system can be operated over a wide range of temperatures, pressures and molecular hydrogen input rates to process different carbonaceous solids and to yield a variety of products.

The recycled streams of this invention also operate to minimize reactor volumes and conversion times. Stream 164 recycles hydrogenated liquid and some solids back to the catalytic reactor by means of ejector 103 where it picks up molecular hydrogen at a relatively low pressure (e.g., 14.7 psi to 1000 psi) from stream 102. Stream 155 recycles hydrogenated liquid and some solids back to the catalytic reactor by means of ejectors 113 and 115 where it picks up molecular hydrogen at a relatively high pressure (e.g., 300 psi to 3000 psi) from stream 118.

A particularly useful feature is provided in the low pressure hydrogen inputs 102, 167, 62 and 58. This low pressure hydrogen can be added in quantities such that substantially reduced quantities of hydrogen gas remain in the respective streams which exit from dissolution vessel 15 or catalytic reactor 121. This avoids the inefficiency of purifying, recycling and re-pressurizing large amounts of gas which have not reacted. One of the most advantageous features of this invention is that smaller amounts (and volumes) of hydrogen gas are required per pass through the catalytic and dissolution vessels for the same volumetric throughput of liquids and overall conversion. This reduction in gas volume results in smaller required reactor volume and a cost savings. To achieve this, the same total amount of hydrogen is reacted but in more than one pass (recycle) at higher flow rates through the reactor and dissolver. In addition, since hydrogenation and dissolution is promoted elsewhere in this invention (solids containment streams and low pressure hydrogen inputs) less total hydrogen must be reacted in the catalytic reactor to achieve the same overall conversion.

The temperature, pressure and recycle flow rates throughout the system of the present invention can be varied to achieve particular goals, e.g., energy efficiency, cost of equipment, recycling time, amount of hydroconversion, product composition, etc. The temperatures, pressures, and volume rates allowed by certain equipment or required to meet these goals are well known in the art. Practical operating pressures and temperatures in the dissolution vessel 15 might be in the range of 200 to 500 psi and 600° F. to 800° F. Typical temperatures and pressures in the catalytic hydrogenation reactors 123 and 129 might be in the range of 500 to 3000 psi and 700° F. to 900° F. The stream passing through tanks 87 and 35 and cyclone separators 45, 47, 81, and 83 would be maintained from 350° F. to 800° F. to ensure low enough viscosities for adequate solids separations. Hydrogen input pressures for streams 167, 62, and 102 range from atmospheric to 3000 psi. The pressure used will be determined by the compressor savings desired and the rate of hydrogen reaction desired. Furthermore, the flow rates and hydrogen addition rate can be varied to achieve desired hydrogenation reaction rates. One way to describe this concept is by a term which combines space velocity and hydrogen addition rates. This term might be called "volumetric hydrogen reaction rate" and has units of standard cubic feet of hydrogen reacted per gallon of reactor-hour. It is the product of liquid hourly space velocity, volume of liquid per hour per volume of reactor, and hydrogen consumption, standard cubic feet per gallon of liquid. Overall volumetric hydrogen reaction rate for one reactor in this invention can range from 0 to 1000 standard cubic feet of hydrogen per gallon of reactor-hour depending on hydrogen pressures and amount of catalyst.

The high rates can exist when many recycle passes are used through a large reactor.

This concept of volumetric hydrogen reaction rate emphasizes a particular advantage of the present invention. In the past, volumetric hydrogen reaction rates in the same range as described have been achieved but only by using high hydrogen addition rates at correspondingly high pressures to provide high volumetric conversion rates. This invention allows a wide variety of hydrogen addition rates and liquid volume rates. Thus, the present invention can be applied for both large-scale commercial uses and small-scale consumer uses.

The type of equipment used in the practice of the present invention also can vary widely. Temperatures and pressures, for example, can dictate what type of pump or ejector are used. Hydrogen addition at inputs 62, 102, and 167 can also determine the type of pump used. Also, the size and amount of particles in the overhead from cyclones 45, 47, 81 and 83 must be minimized so as not to damage or excessively wear the pumps. The particle size in the feed to the cyclones must also be smaller than a predetermined size to pass into the cyclones. However, a significant advantage of the present invention is that it allows use of less expensive equipment to achieve the same degree of hydroconversion. Again, this means hydroconversion of carbonaceous materials with this invention can be more economic for relatively small-scale consumer uses.

As described above, various boiling point fractions of liquid and various amounts and compositions of gas can be passed through tanks 95, 151 and 177. These fractions might be described as product since they are not recycled in the system. Of course, a variety of factors will determine the composition of these fractions. The time of separation and the temperature and pressure of separation are obvious ways to vary the products.

Another feature of the present invention is provided in a semi-automatic batch use, as well as a continuous use. As described, stream 97 can be used to convey the overhead material from cyclones 81 and 83 to holding tank 101. This can be a convenient manner of storing a liquid for use in the next batch run even before the desired system hydroconversion has been achieved and the system emptied of product. The product liquid created can have too high a hydrogen content to be a good hydrogen donor solvent. When it is desirable to retain a portion of the process liquid for use in processing the next batch of hydrocarbon solid, some process liquid can be transferred to tank 101 before hydroconversion levels in the process liquid become too high.

One way to determine when to use stream 97 to charge tank 101 is by monitoring the chemically bound hydrogen content of the liquid in the system. Methods of measuring this chemically bound hydrogen content are well known in the art. The chemically hydrogen bound content of the solvent for the charge tank should not be allowed to exceed about 9% to 11% by weight, since permitting higher hydrogen levels would destroy the hydrogen donating capability of the solvent.

After the system has been emptied and it is desired to charge the system again for a new batch, pumps 109 and 67 can be used to draw the liquid in tank 101 through streams 187 and 189, respectively.

If desired, the system can be charged with a hydrogen donor solvent obtained from outside sources. Hydrogenated creosote oil, anthracine oil, or other coal derived liquids hydrogenated to contain about 6% to about 11% hydrogen by weight are suitable for this purpose.

Thus, the method for hydroconversion of solid carbonaceous materials of the present invention is well adapted to attain the objects and advantages mentioned as well as those inherent therein. While presently preferred embodiments of the invention have been described for the purpose of this disclosure, numerous changes in the construction and arrangement of equipment and variations in conducting the streams can be made by those skilled in the art which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. A process for hydroconversion of solid carbonaceous materials comprising the steps of:

contacting in a dissolution zone particulate solid carbonaceous material with a hydrocarbon solvent;

removing from said dissolution zone a first stream containing hydrocarbon liquids, hydrocarbon gases, and particulate carbonaceous material;

separating said first stream into a second stream and a third stream, said second stream consisting substantially of gas phase material;

separating with a solids separation device said third stream into a fourth stream and a fifth stream, said fourth stream having an average solid size smaller than the average solid size in said fifth stream;

introducing at least a portion of said fifth stream into said dissolution zone;

separating said fourth stream into a sixth stream and a seventh stream;

introducing at least a portion of said seventh stream into said third stream;

adding molecular hydrogen to said sixth stream;

heating said sixth stream;

introducing said sixth stream into a catalytic hydrogenation zone;

removing from said catalytic hydrogenation zone an eighth stream;

separating said eighth stream into a ninth stream and a tenth stream, said ninth stream consisting substantially of gas phase materials;

introducing at least a portion of said tenth stream into said fourth stream; and repeating the above steps until the desired amount of hydroconversion is achieved.

2. The process of claim 1 which further comprises the step of introducing at least a portion of said second stream into said sixth stream.

3. The process of claim 1 which further comprises the step of introducing at least a portion of said ninth stream into said sixth stream.

4. The process of claim 1 further comprising the step of exchanging heat between said sixth stream and tenth stream prior to heating said sixth stream.

5. The process of claim 1 which comprises the further step of introducing a portion of said tenth stream into said sixth stream.

6. The process of claim 5 which further comprises the step of introducing a portion of said sixth stream into said tenth stream.

7. The process of claim 1 which comprises the further step of introducing heated molecular hydrogen to said catalytic hydrogenation zone.

8. The process of claim 1 which comprises the further step of introducing at least a portion of said eighth stream into said sixth stream.

9. The process of claim 1 which further comprises the step of adding molecular hydrogen to said fifth stream.

10. The process of claim 1 which further comprises the step of adding molecular hydrogen to said fourth stream.

11. The process of claim 1 wherein said catalytic hydrogenation zone comprises a free floating bed catalytic reactor.

12. The process of claim 1 wherein said dissolution zone comprises a free floating bed reactor.

13. The process of claim 1 wherein said fifth stream is introduced to said dissolution zone in two directions to produce mixing by cross-flow in said dissolution zone.

14. The process of claim 1 wherein said sixth stream is introduced to said catalytic hydrogenation zone in two directions to produce mixing by cross-flow in said catalytic hydrogenation zone.

15. The process of claim 1 wherein said catalyst in said catalytic hydrogenation zone is selected from the group consisting of cobalt molybdate, tungsten nickel sulfide, nickel molybdate, tabular alumina, bauxite, and mixtures thereof.

16. The process of claim 1 which further comprises the step of separating a liquid fraction from said tenth stream, said liquid fraction boiling below a temperature between about 250° F. and 450° F.

17. The process of claim 16 comprising the further step of introducing at least a portion of said liquid fraction into said third stream.

18. The process of claim 1 which further comprises the steps of measuring the chemically bound hydrogen content of at least one of said streams, and when said chemically bound hydrogen content exceeds about 9% to 11% by weight, separating a portion of at least one of said streams for starting a subsequent process of hydroconversion.

19. The process of claim 1 wherein said molecular hydrogen is added to said sixth stream in a gaseous state at a first pressure, and which further comprises the steps of:

dispersing said gaseous molecular hydrogen in said sixth stream; and after said dispersing step, increasing the pressure of said sixth stream to a pressure higher than said first pressure.

20. The process of claim 10 wherein said molecular hydrogen is added to said fourth stream in a gaseous state at a first pressure, and which further comprises the steps of:

dispersing said gaseous molecular hydrogen in said fourth stream; and after said dispersing step, increasing the pressure of said fourth stream to a pressure higher than said first pressure.

21. The process of claim 1 wherein the step of introducing at least a portion of said seventh stream into said third stream comprises:

introducing said seventh stream into the motive inlet of an ejector; and introducing said third stream into the suction intake of said ejector.

22. The process of claim 1 which further comprises the step of introducing at least a portion of said fifth stream into said third stream.

23. The process of claim 1 which further comprises the step of passing at least a portion of said sixth stream through a second solids separation device such that a larger solids stream is removed from said sixth stream having an average solids size larger than the average solid size remaining in said sixth stream subsequent to said second solids separation device.

24. The process of claim 23 which further comprises the step of introducing at least a portion of said larger solids stream into said sixth stream prior to said second solids separation device.

25. The process of claim 24 wherein said larger solids stream is introduced to stream six by means of an ejector, the motive side of the ejector being driven by said sixth stream prior to said second solids separation device and the suction side of the ejector being fed by said larger solids stream.

26. The process of claim 24 which further comprises the step of passing said larger solids separated in said solids separation device through a solids and liquids retention tank such that solids larger than a predetermined size will be retained in said tank.

27. The process of claim 1 which further comprises the step of passing said third stream through a solids retention tank before combining said third stream and said seventh stream such that solids larger than a predetermined size will be retained in said retention tank.

28. The process of claim 1 which further comprises the step of adding molecular hydrogen to said tenth stream.

29. A process for hydroconversion of carbonaceous materials comprising the steps of:

contacting in a dissolution zone particulate solid carbonaceous material with a hydrocarbon solvent;

removing from said dissolution zone a first stream containing hydrocarbon liquids and particulate carbonaceous material;

introducing said first stream into the suction portion of an ejector, the motive fluid of said ejector being a second stream, the first and second streams forming a third stream which exits from said ejector;

separating with a solids separation device said third stream into a fourth stream and a fifth stream, said fourth stream having an average solids size smaller than said fifth stream;

introducing at least a portion of said fifth stream into said first stream;

hydrogenating the hydrocarbon liquid in at least one of said streams; and repeating the above steps until the desired amount of hydroconversion is achieved.

30. The process of claim 29 which further comprises the step of adding molecular hydrogen to said second stream.

31. The process of claim 30 wherein said molecular hydrogen is added to said second stream in a gaseous state at a first pressure, and which further comprises the steps of:

dispersing said gaseous molecular hydrogen into said second stream; and after said dispersing step increasing the pressure of said second stream to a pressure higher than said first pressure.

32. A process for hydroconversion of solid carbonaceous material comprising the steps of:

introducing a first stream containing a hydrocarbon solvent and solid particulate carbonaceous material into the suction port of an ejector, the motive fluid of said ejector being a second stream which enters the motive inlet of said ejector, said first and second streams forming a third stream which exits from said ejector;

separating with a solids separation device said third stream into a fourth stream and a fifth stream, said fourth stream having an average solids size smaller than said fifth stream;

introducing at least a portion of said fifth stream into said first stream; and repeating said steps until the desired amount of hydroconversion is achieved.

33. The process of claim 32 which further comprises the steps of:

introducing gaseous molecular hydrogen to said second stream at a first pressure;

dispersing said gaseous molecular hydrogen in said second stream; and increasing the pressure of said second stream to a pressure higher than said first pressure after said dispersing step.

34. The process of claim 32 which further comprises the step of passing said fifth stream through a solids and liquid retention tank before introducing said fifth stream into said first stream such that solids larger than a predetermined size are retained in said retention tank.

35. The process of claim 32 which further includes the step of introducing at least a portion of said fourth stream into said second stream.

36. A process for hydroconversion of solid carbonaceous materials comprising the steps of:

contacting in a dissolution zone particulate solid carbonaceous materials with a hydrocarbon solvent;

removing from said dissolution zone a first stream containing hydrocarbon liquids and particulate carbonaceous material;

separating with a solids separation device said first stream into a second stream and a third stream, said second stream having an average solids size smaller than the average solids size in said third stream;

introducing at least a portion of said third stream into said dissolution zone;

separating said second stream into a fourth stream and a fifth stream;

introducing at least a portion of said fifth stream into said first stream;

adding molecular hydrogen to said fourth stream;

heating said fourth stream;

introducing said fourth stream into a catalytic hydrogenation zone;

removing from said catalytic hydrogenation zone a sixth stream;

separating said sixth stream into a seventh stream and an eighth stream, said seventh stream consisting substantially of gas phase material;

introducing at least a portion of said eighth stream into said second stream; and repeating the above steps until the desired amount of hydroconversion is achieved.

37. A process for hydroconversion of solid carbonaceous materials comprising the steps of:

contacting in a dissolution zone particulate solid carbonaceous material with a hydrocarbon solvent;

removing from said dissolution zone a first stream containing hydrocarbon liquids and particulate carbonaceous materials;

separating with a solids separation device said first stream into a second stream and a third stream, said second stream having an average solids size smaller than the average solids size in said third stream;

introducing at least a portion of said third stream into said dissolution zone;

adding molecular hydrogen to said second stream;

heating said second stream;

introducing said second stream into a catalytic hydrogenation zone;

removing from said catalytic hydrogenation zone a fourth stream;

introducing at least a portion of said fourth stream into said first stream; and repeating the above steps until the desired amount of hydroconversion is achieved.

38. A process for hydroconversion of solid carbonaceous materials comprising the steps of:

introducing a first stream containing a hydrocarbon solvent and solid particulate carbonaceous material into the suction port of an ejector, the motive fluid of said ejector being a second stream containing hydrocarbon solvent which enters the motive inlet of said ejector, said first and second streams forming a third stream which exits from said ejector;

separating with a solids separation device said third stream into a fourth stream and a fifth stream, said fourth stream having an average solids size smaller than said fifth stream;

introducing at least a portion of said fifth stream into said first stream; and repeating said steps until the desired amount of hydroconversion is achieved.

39. The process of claim 38 which further includes the step of introducing at least a portion of said fourth stream into said second stream.

40. The process of claim 38 which further includes the step of hydrogenating at least a portion of said fourth stream and introducing said hydrogenated fourth stream into said second stream.

41. A process for hydroconversion of solid carbonaceous materials comprising the steps of:

contacting in a dissolution zone particulate solid carbonaceous material with a hydrocarbon solvent;

removing from said dissolution zone a first stream containing hydrocarbon liquids, hydrocarbon gases, and particulate carbonaceous material;

separating said first stream into a second stream and a third stream, said second stream consisting substantially of gas phase material;

separating with a solids separation device said third stream into a fourth stream and a fifth stream, said fourth stream having an average solid size smaller than the average solid size in said fifth stream;

introducing at least a portion of said fifth stream into said dissolution zone;

separating said fourth stream into a sixth stream and a seventh stream;

introducing at least a portion of said seventh stream into said third stream;

adding molecular hydrogen to said sixth stream;

heating said sixth stream;

introducing said sixth stream into a catalytic hydrogenation zone;

removing from said catalytic hydrogenation zone an eighth stream; and repeating the above steps until the desired amount of hydroconversion is achieved.

42. The process of claim 41 which further includes the step of introducing at least a portion of said eighth stream into said fourth stream.

* * * * *